US012649097B2

(12) United States Patent
Costabile et al.

(10) Patent No.: US 12,649,097 B2
(45) Date of Patent: Jun. 9, 2026

(54) BASKETBALL GOAL SENSING SYSTEM

(71) Applicants: Michael Joseph Costabile, Shallotte, NC (US); Patrick Sean Finnerty, Sunset Beach, NC (US); Anthony R. Kobet, Clemmons, NC (US); Dennis Brady Whitley, Cooleemee, NC (US)

(72) Inventors: Michael Joseph Costabile, Shallotte, NC (US); Patrick Sean Finnerty, Sunset Beach, NC (US); Anthony R. Kobet, Clemmons, NC (US); Dennis Brady Whitley, Cooleemee, NC (US)

(73) Assignee: RIGHT TIME SPORTS, LLC, Supply, NC (US)

( * ) Notice: Subject to any disclaimer, the term of this patent is extended or adjusted under 35 U.S.C. 154(b) by 263 days.

(21) Appl. No.: 18/207,114

(22) Filed: Jun. 7, 2023

(65) Prior Publication Data

US 2024/0408474 A1 Dec. 12, 2024

(51) Int. Cl.
*A63B 71/06* (2006.01)
*A63B 63/08* (2006.01)

(52) U.S. Cl.
CPC ..... *A63B 71/0605* (2013.01); *A63B 63/083* (2013.01); *A63B 2063/086* (2013.01); *A63B 2220/62* (2013.01); *A63B 2220/805* (2013.01); *A63B 2220/833* (2013.01)

(58) Field of Classification Search
None
See application file for complete search history.

(56) References Cited

U.S. PATENT DOCUMENTS

| | | | | |
|---|---|---|---|---|
| 5,039,977 | A * | 8/1991 | Mele | A63B 71/06 273/371 |
| 6,389,368 | B1 * | 5/2002 | Hampton | A63B 71/0669 473/480 |
| 6,980,113 | B1 * | 12/2005 | Uehran | A63B 71/06 377/5 |
| 10,695,634 | B2 * | 6/2020 | Cuenin | A63B 69/0071 |
| 11,701,567 | B2 * | 7/2023 | Tsai | A63B 63/083 473/480 |
| 12,285,653 | B2 * | 4/2025 | Marty | A63B 24/0062 |
| 2008/0254866 | A1 * | 10/2008 | Young | A63B 71/0622 463/25 |
| 2014/0200692 | A1 * | 7/2014 | Thurman | G09B 19/0038 700/91 |
| 2023/0031488 | A1 * | 2/2023 | Gordon | G09B 19/0038 |

* cited by examiner

*Primary Examiner* — Sunit Pandya
(74) *Attorney, Agent, or Firm* — Dilworth & Barrese, LLP

(57) ABSTRACT

A basketball goal sensing system includes a sensor assembly integrated with the cover plate pad of a commercially available basketball hoop. The sensor assembly includes a plurality of infrared LEDs and a plurality of sensors for detecting infrared light that reflects off an object passing through the basketball rim and/or net. If an object passing through the rim and/or net exhibits a reflective profile of a basketball, the system considers the event to be a goal and transmits a signal to the base station. If that goal is a clock-stopping event the game clock is stopped.

9 Claims, 7 Drawing Sheets

BASKETBALL GOAL SENSING SYSTEM

BACKGROUND OF THE INVENTION

The present invention relates generally to sports timing and scoring systems, and more particularly, to a basketball goal sensing system.

A basket, or a "goal" is a clock-stopping event in many basketball leagues. For example, current National Basketball Association ("NBA") rules dictate that goals made in the last minute of the first, second and third period, and in the last two minutes of the fourth or overtime period, are clock-stopping events. Other leagues, such as National Collegiate Athletics Association ("NCAA") basketball have their own set of rules regarding when goals stop the game clock.

One of the challenges of a goal being a clock-stopping event is the difficulty in ascertaining when exactly the clock should stop. While the rule may be fairly straightforward—for example the clock stops when the basketball clears the bottom of the net—in practice this is difficult. Basketballs pass through the net at different speeds, and an official may not have a clear view of the basketball passing through the net. Based on these and other variables, it is extremely common for officials to have to stop a game, review replay footage, adjust the clock, and resume play in an attempt to fairly apply the rule. This is costly, frustrating to players, fans, coaches and officials, and it results in a loss of momentum during critical game periods.

Another related problem is ascertaining whether a given goal is a clock-stopping event or not. By way of example, a goal in the fourth quarter of a NCAA game isn't a clock-stopping event if the basketball clears the bottom of the net with 1.01 seconds remaining but would be a clock-stopping event with 1.00 seconds remaining. Even with replay, these razor-thin determinations can be both subjective and determinative of the winner.

Given the criticality of ascertaining when a goal registers as a goal, others have attempted to develop goal sensors, but with little success. Problems include visible hardware that is distracting and dangerous to players, "sensors" that are unable to distinguish between basketballs and other objects such as hands, lack of integration with existing game timing systems, and/or the inability to sense some shots, particularly "flat" shots that fail to activate elevated sensors. The NBA currently employs camera-based systems for ball tracking, but these systems are unable to affirmatively establish when a goal has been made.

As can be seen, there is a need for a basketball goal sensing system capable of accurately determining if and when a goal is scored. It is desirable that this system is visually and physically non-obtrusive, and that it can be integrated with a basketball timing system. It is also desirable that this system can be used with a variety of basketball hoop systems.

At least one inventor of the present invention has invented related advances in the field, as set forth in the following references below. These references are incorporated by reference in their entireties.

SPORTS MONITORING AND TRACKING SYSTEM described in U.S. Pat. No. 7,920,052 which issued Apr. 5, 2011 and pertains to specific signal generators, typically whistles, starting and stopping a game timer. This technology essentially negated the interference of background noise to allow specific game whistles to automatically activate the game timer.

SYSTEM FOR REMOTELY STARTING AND STOPPING A TIME CLOCK IN AN ENVIRONMENT HAVING A PLURALITY OF DISTINCT ACTIVATION SIGNALS described in U.S. Pat. No. 10,504,300 which issued Dec. 10, 2019 and pertains to starting and stopping a game clock with a variety of pre-identified whistles, and collecting data related thereto. This technology essentially improved the SPORTS MONITORING AND TRACKING SYSTEM invention by allowing referees to use their own whistles whose sonic fingerprints had been established, and collecting whistle blowing data on each referee based on those unique fingerprints.

SYSTEM AND METHOD FOR COLLECTING DATA IN A LIVE SPORTING EVENT described in PCT/US2020/027135 filed Apr. 8, 2020 pertains to communication bundles, hoop sensors and a time clock, all communicatively coupled and configured to collect environmental, biometric and game-related data during a game.

SONIC GENERATOR FOR USE WITH A TIMING AND DATA COLLECTION SYSTEM FOR A LIVE SPORTING EVENT described in U.S. application Ser. No. 17/333,784 filed May 8, 2020 pertains to a device that replaces a conventional whistle used in officiating sporting events.

BELTPACK PAIRING SYSTEMS FOR USE WITH SPORTS TIMING AND DATA COLLECTION SYSTEMS AND METHODS OF USING described in U.S. application Ser. No. 17/501,565 filed Oct. 14, 2021 pertains to a system employing unique identifier codes for recognition by the base station.

SUMMARY OF THE INVENTION

A basketball goal sensing system includes a sensor assembly that is integrated with the cover plate pad of a commercially available basketball hoop in a manner that doesn't significantly change the aesthetics or functionality of that cover plate pad. The sensor assembly includes a plurality of infrared LEDs and a plurality of sensors for detecting infrared light that reflects off an object passing through the basketball rim and net. A basketball passing through the basketball rim will activate the sensors within certain ranges with respect to the order of sensor activation, speed, reflection, and so forth. This standard profile is programmed into the system. When an object activates sensors of the system, for example by passing through the hoop and/or net, the sensor data is compared to the pre-existing standard profile of a basketball passing through. If the object's profile matches the system's basketball profile within certain tolerances, the system considers the event to be a goal, and transmits a signal to the base station indicating a goal has occurred. If that goal is a clock-stopping event the game clock is stopped. The system is particularly well suited for integration with various sports timing systems conceived of by the applicant.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

The following structure numbers shall apply to the following structures among the various FIGS.:

10—Goal sensing system;
12—Power supply;
14—Timing system;
15—Base station;
16—Timekeeper;
17—Signal;
18—Basketball;
19—Scoreboard;
20—Basketball hoop;
21—Backboard;
22—Breakaway assembly;
23—Cover plate pad;
24—Cover plate pad depression;
25—Rim;
26—Net;
27—Power outlet;
30—Sensor assembly;
31—Housing;
32—Housing front surface;
34—Housing back surface;
36—Housing edge;
40—Rigid-flex PCB;
41—Upper wing;
42—Lateral wing;
43—Flexible region;
44—Processor;
45—Amplifier;
46—Antenna;
47—Terminal blocks;
48—Mounting apertures;
50—Left sensor;
51—Left sensor field of view;
52—Central sensor;
53—Central sensor field of view;
54—Right sensor;
55—Right sensor field of view;
56—Mounting screws;
60—Upper left LED;
61—Lower left LED;
63—Left central LED;
64—Right central LED;
66—Upper right LED;
67—Lower right LED;
70—Sensor lens; and
72—LED lead.

As used herein, a "goal" is synonymous with "scoring a basket". A "basketball hoop" shall refer to the assembly including the backboard, rim, net, pole, and ancillary parts. To avoid confusion "goal" will not be used to refer to a basketball hoop, and "basketball hoop" will not be used to refer specifically to a rim, although both usages are common in everyday language.

Broadly, the present invention pertains to a goal sensing system capable of identifying that a basketball goal has occurred and sending a signal to an auxiliary unit such as a base station to time-stamp that goal. In a preferred embodiment the goal sensing system is integrated with a basketball timing system, and most preferably with basketball timing systems and related inventions set forth in the BACKGROUND OF THE INVENTION section herein.

Figure 1:
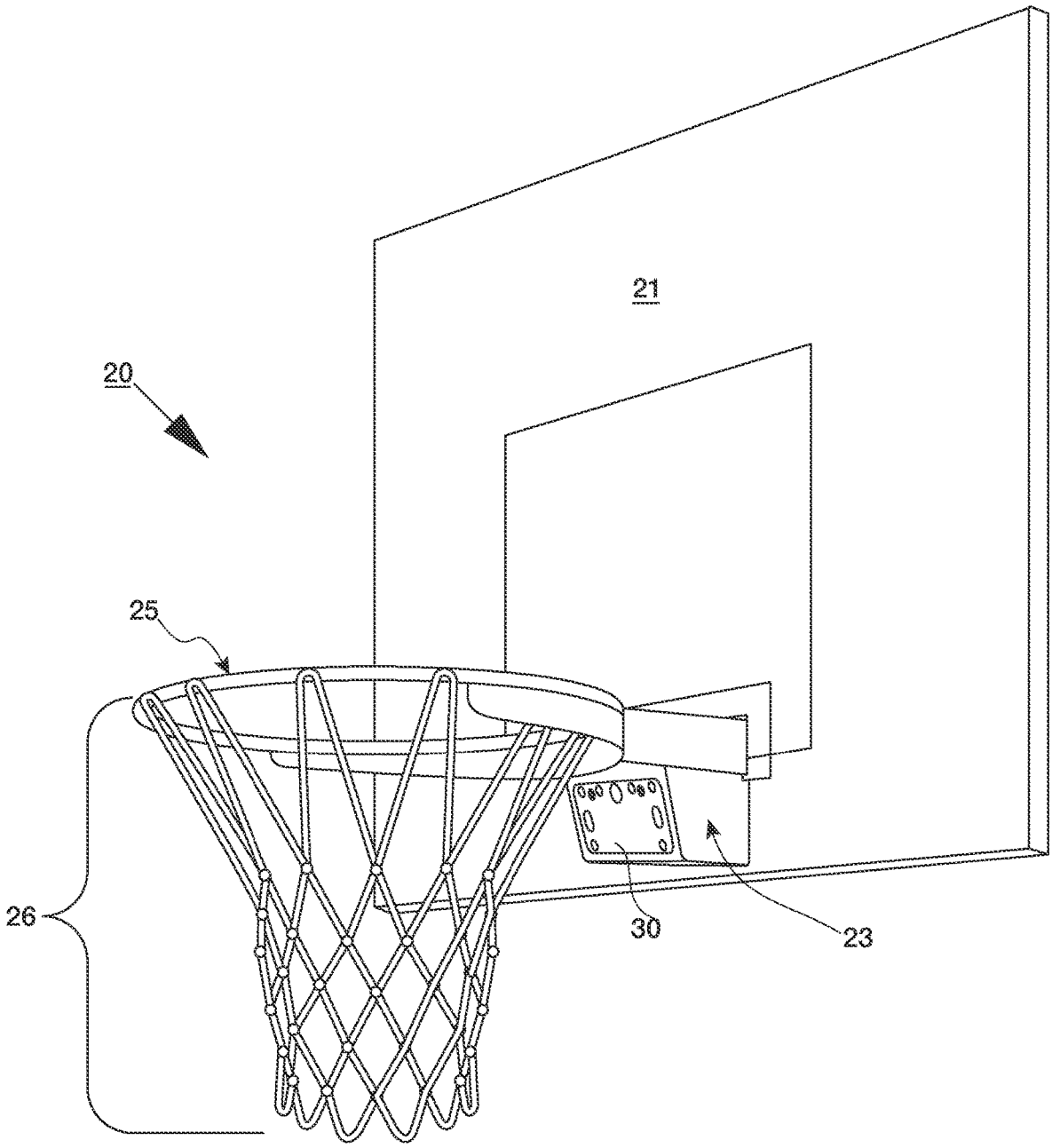
FIG. 1 depicts a basketball hoop having of a goal sensing system of the present invention.

Referring to FIG. 1, basketball hoop 20 includes backboard 21, rim 25 and net 26. Basketball hoops with breakaway rims are preferred, for example the ARENA 180 GOAL from SPALDING EQUIPMENT in Bowling Green, Kentucky, which includes breakaway assembly 22 (not shown) concealed within cover plate pad 23. In the present invention, cover plate pad 23 is modified to releasably engage sensor assembly 30.

Figure 2:
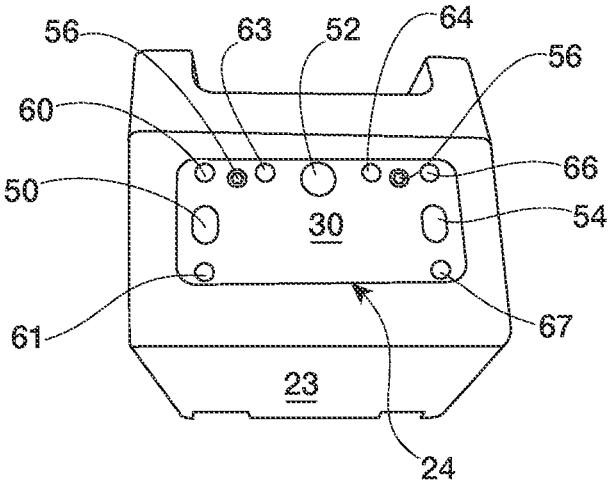
FIG. 2 depicts a perspective view of a sensor assembly within a cover plate pad.

FIG. 2 depicts in more detail sensor assembly 30 within cover plate pad 23. Starting at the lower left corner and going clockwise, the structures include lower left LED 61, left sensor 50, upper left LED 60, mounting screw 56, left central LED 63, central sensor 52, right central LED 64, mounting screw 56, upper right LED 66, right sensor 54 and lower right LED 67. As can be seen, each sensor has two associated LEDs, with each LED positioned on either side of the sensor.

Figure 3:
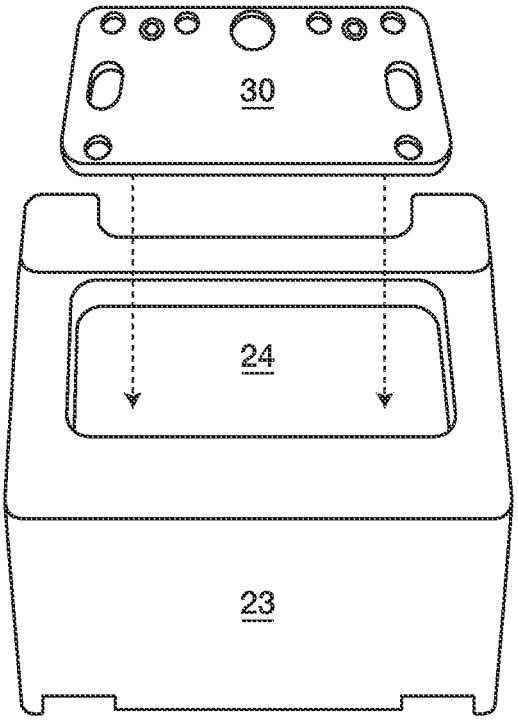
FIG. 3 depicts a perspective view of a sensor assembly removed from the cover plate pad depression of a cover plate pad.

FIG. 3 depicts insertion of sensor assembly 30 into cover plate pad depression 24. Cover plate pad depression 24 may be a post-manufacturing modification to an off-the-shelf cover plate pad, namely, a deepening and widening of the depression that holds the manufacturer's face plate (not shown). A face plate conventionally identifies the brand of the basketball hoop, for example "SPALDING".

Figure 4:
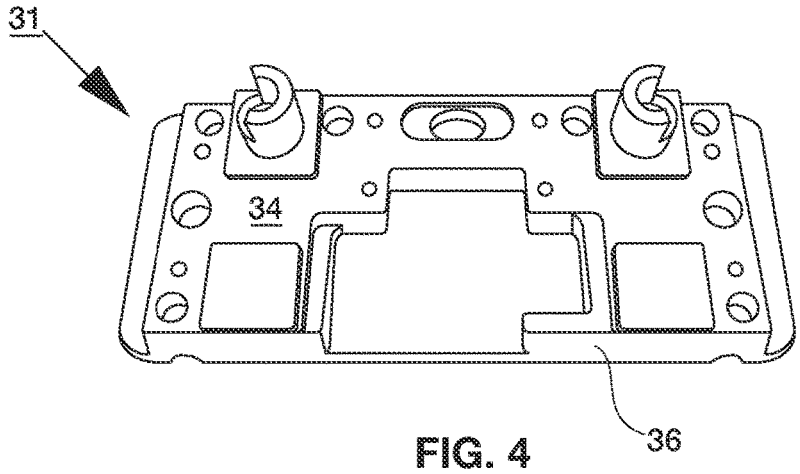
FIG. 4 depicts a perspective view of a housing back surface.
Figure 5:
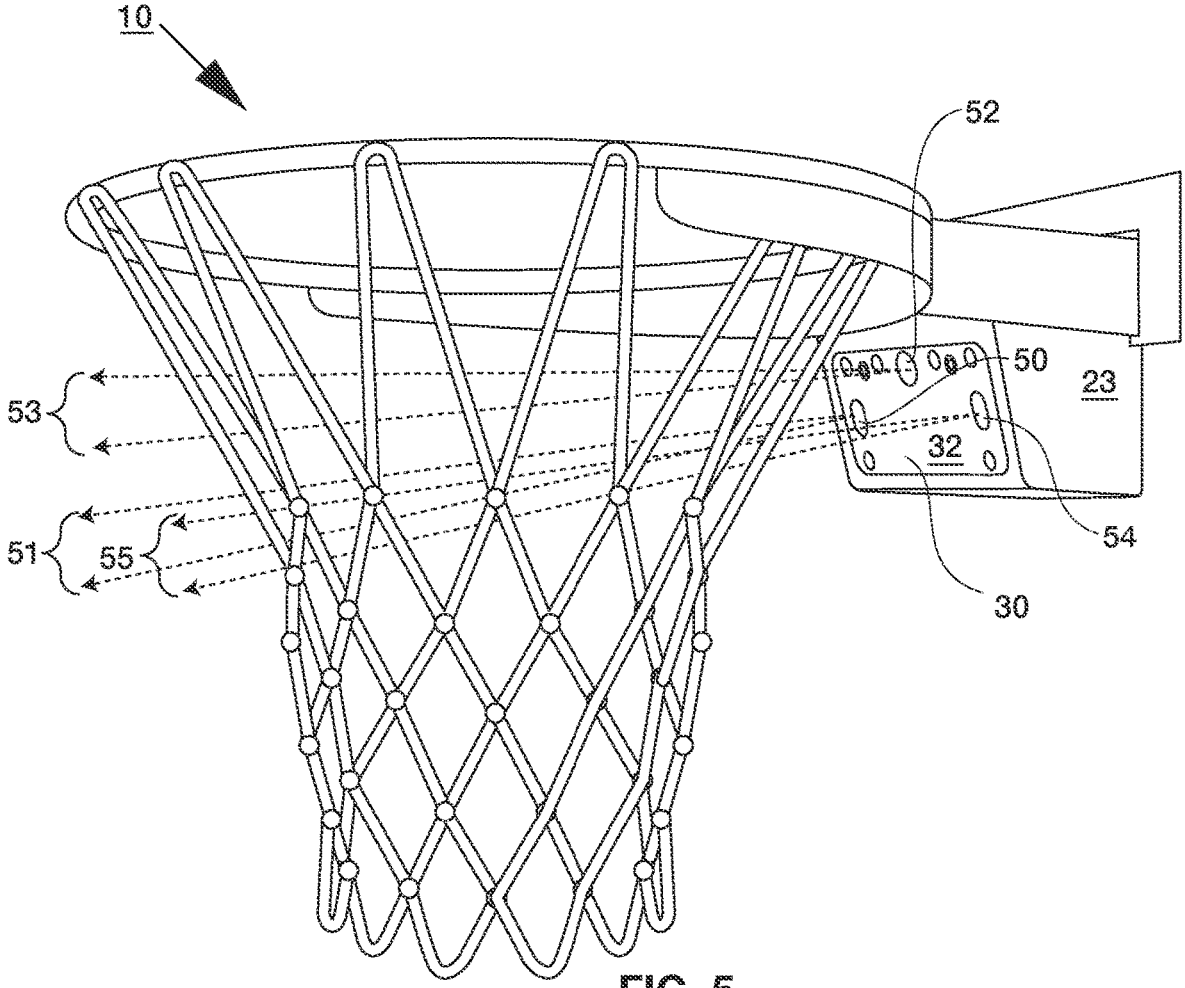
FIG. 5 depicts sensor fields of view from sensors of the present invention.
Figure 6:
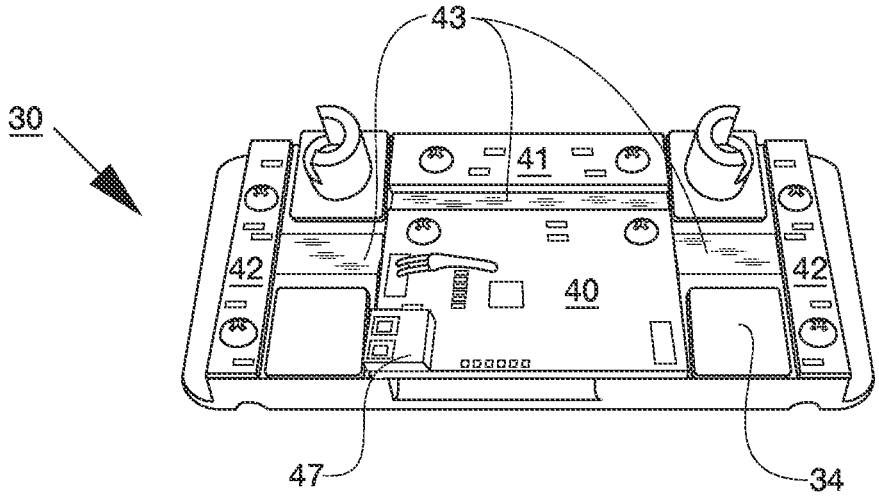
FIG. 6 depicts a rigid-flex PCB coupled with a housing back surface.

FIG. 4 depicts housing back surface 34, against which structures such as rigid-flex PCB 40 are attached, as shown in FIG. 6. Housing front surface 32 is the outwardly facing surface, also shown as sensor assembly 30 in FIG. 5.

Referring back to FIG. 2, in use left LEDs 60, 61, right LEDs 66, 67 and central LEDs 63, 64 each emit infrared ("IR") light outwardly towards the rim and net. An object passing in front of the IR light will likely reflect at least some of that light back towards left, right and central sensors 50, 54 and 52. Whether that object is determined to be a basketball and triggers a signal that a goal has been scored depends on whether the sensors are activated in a manner compliant with pre-established parameters set forth in the sensor activation profiles stored in processor 44. The sensor activation profiles are preferably stored in the internal flash memory of the on-board microcontroller unit.

Figure 10:
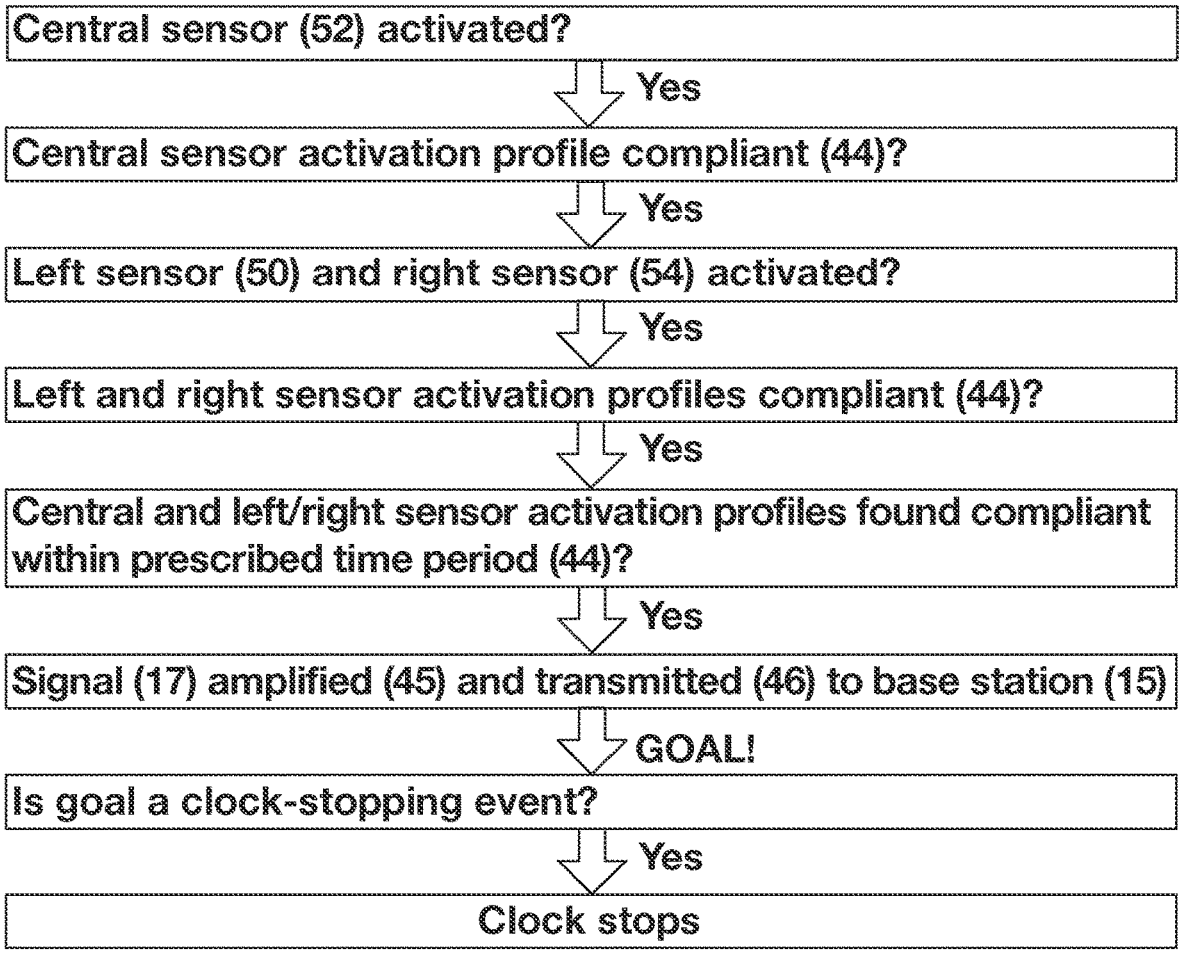
FIG. 10 diagrammatically depicts some processes performed by the goal sensing system.

Referring to FIG. 10, the preferable protocol dictates that if central sensor 52 is activated, that activation must be compliant with the associated activation profile prior to considering whether left or right sensors 50, 54 are activated, and if so then whether left or right sensor activations are compliant with the associated profiles. Said another way, the preferred system requires that central sensor 52 be activated before left or right sensors 50, 54. This ensures that the object passing in front of the IR light is traveling in a downward direction, versus for example a hand extending upwardly into the net. In a preferred embodiment central sensor 52 is able to ascertain the type of shot, for example whether it is a 3 pointer, lay-up or dunk, based on the activation profile.

Activation compliance profiles also require that the time between activation of central sensor 52 and left and right sensors 50, 54 must fall within the range of approximately 2-11 milliseconds. This confirms that the object passing in front of the IR light is traveling at a speed consistent with a basketball going through a hoop, versus for example a beer cup thrown into the rim by a fan. The exit timing of the lower sensor is used for determining the goal event trigger. Another measurement considered by the activation compliance profiles is how much light is reflected into the sensor by the object. This helps ensure that only objects having the characteristic size, shape and material of a basketball can generate a goal.

Figure 9:
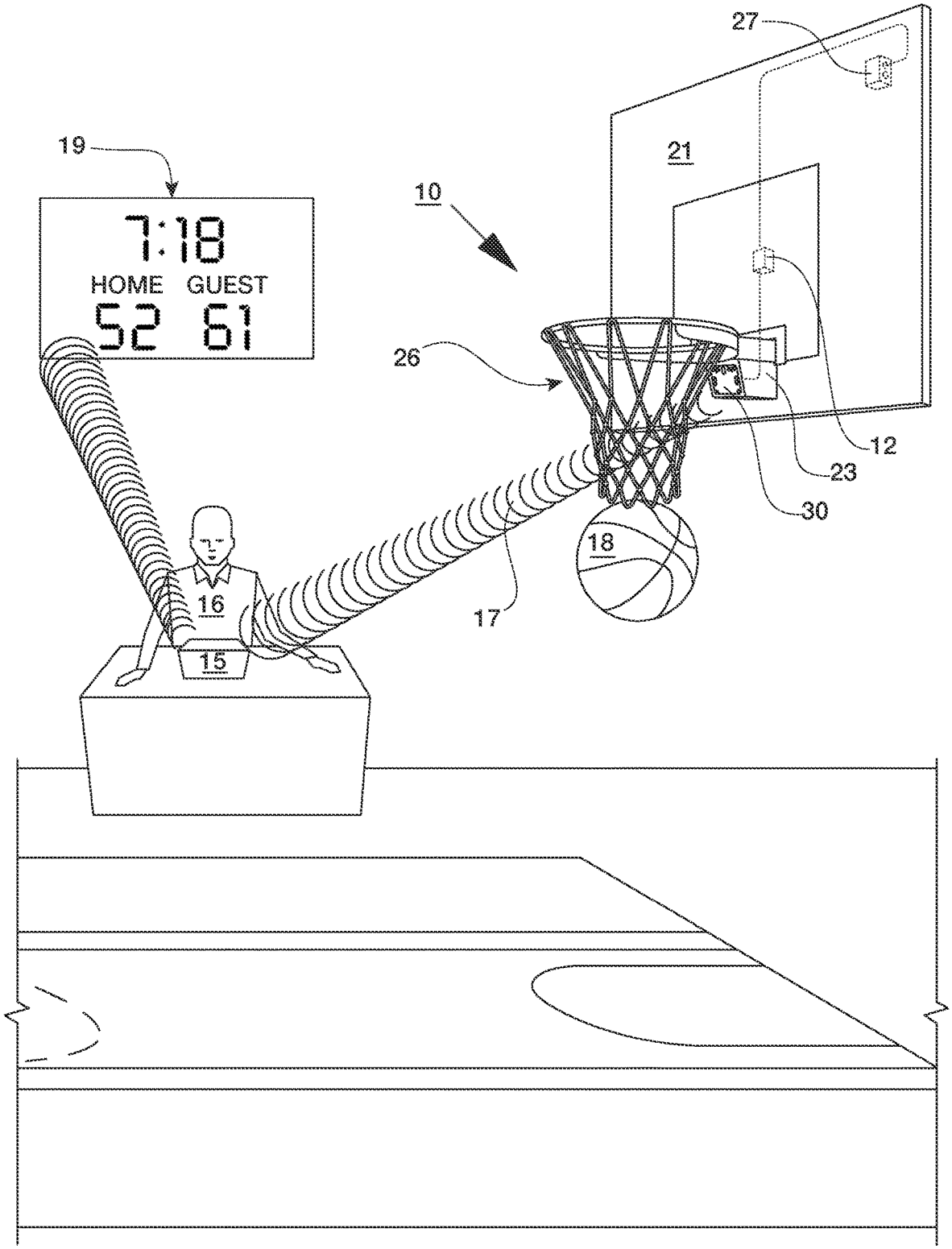
FIG. 9 depicts a goal sensing system in use.

When an event triggers the microcontrollers of the system to determine that the resulting sensor activations are compliant with pre-established profiles, in other words a goal, signal 17 is amplified by amplifier 45 and transmitted by transmitter 46 to base station 15, as set forth in FIGS. 9 and 10. In a preferred embodiment the signal has a frequency of approximately 900-928 MHz for applications in the United States, or approximately 868 MHz for Europe. In addition to signal 17 notifying base station 15 that a goal has been made, it identifies which basketball hoop based on preloaded serial numbers, and stops the clock if appropriate based on whether a goal is a clock-stopping event in view of the time remaining in the game period.

It is noted that free throws take place when the clock is not running, and are not clock-stopping events. However, the system is preferably configured to sense when a free throw is made, to signal base station 15 accordingly for logging the event and points earned.

In normal operation during a game, signals are transmitted from sensor assembly 30 to base station 15. However, the system is configured for base station to sensor assembly signal transmission, for example pre-game set up protocols such as assigning basketball hoop identities, for making on-the-fly parameter adjustments, and for initiating soft resets.

FIG. 5 depicts substantially horizontally directed central sensor field of view 53, plus downwardly directed left and right sensor field of views 51, 55. In a preferred embodiment left and right sensor fields of view are parallel and offset approximately 0°-90° relative to the central sensor field of view, with approximately 10°-30° being more preferred, and approximately 19° being most preferred. It is also preferred that all fields of view are circular, and each spans an arc of approximately 5°, as dictated by sensor lens 70 shown in FIG. 7.

Referring back to FIG. 4, while the present invention disclosed is optimal for use with SPALDING'S ARENA 180 GOAL, housing 31 can be configured for use with other systems. By way of example, housing 30 defines housing edge 36 of a specific thickness, here approximately 13-14 mm, such that sensor assembly 30 lays substantially flush within cover plate pad 23 as shown in FIG. 5, yet central sensor 52 is directed substantially horizontally outward. In this case the specific angle of housing front surface 32 relative to housing back surface 34 created by housing edge 36 is approximately 5°, with a total angle of approximately 19° when factoring in the angle of mounting surface of cover plate pad 23. However, a different basketball hoop manufacturer may have a different cover plate pad mounting surface, in which case housing edge 36 would need to be thicker or thinner in order to tilt sensor assembly 30 upward or downward to achieve horizontal central sensor field of view 53. It is a feature of this invention that the system can be used with a variety of commercially available basketball hoops by modifying the front surface to back surface angle of the housing to properly align central sensor 52 in view of different configurations of different basketball hoops.

It is a significant benefit of the system that it can be used with a variety of basketball hoop systems by employing housings with different geometries. However, simply tilting the entire sensor assembly either upward or downward isn't workable because while central sensor 52 needs to be substantially horizontally aligned, left and right sensors 50, 54 are preferably aligned such that their fields of view are approximately in the mid to lower half of the net. Said another way, the upward and downward tilt of left and right sensors 50, 54 must be independent of central sensor 52, otherwise each basketball hoop system would require a different circuit board so sensors are properly directed.

Figure 7:
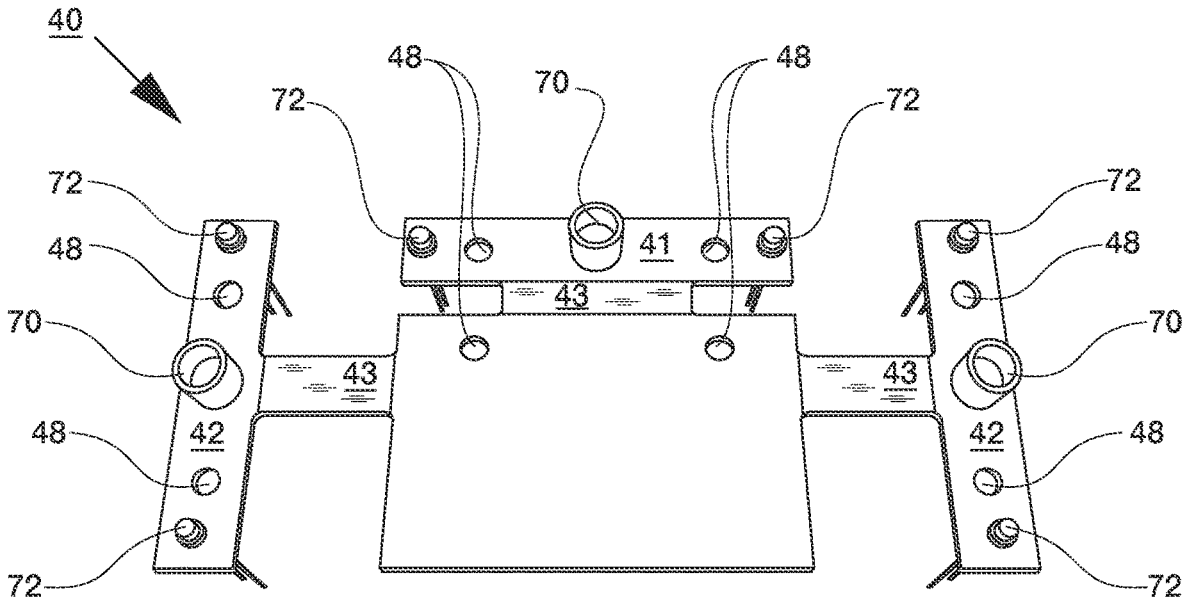
FIG. 7 depicts a top perspective view of a rigid-flex PCB.
Figure 8:
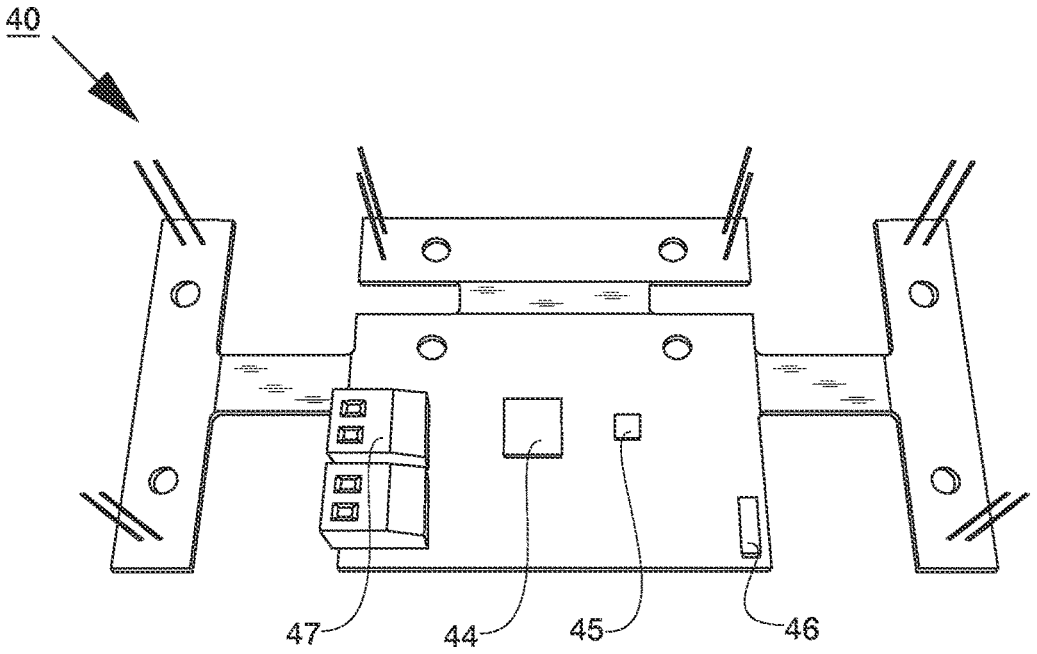
FIG. 8 depicts a bottom perspective view of a rigid-flex PCB.

Another important feature of the present invention is that the technical challenges of using a single circuit board with a variety of housings, while still facilitating independent tilt of the various sensors, has been overcome. Referring to FIG. 7, rigid-flex printed circuit board 40 includes three flexible regions 43, thereby allowing upper wing 41 and lateral wings 42 to each independently flex relative to the remainder of the PCB. Accordingly, central, left and right sensors 52, 50, 54 and corresponding central, left and right fields of view 53, 51, 55 are independently directable and can be used with housings 31 having different configurations.

In a preferred embodiment sensor assembly 30 includes at least one terminal block 47 (FIG. 6), which is electrically coupled to power supply 12 (FIG. 9), which is powered by power outlet 27 on backboard 21. It is further preferred that associated wires run under cover plate 23 to back of backboard 21 so as to be physically and visually non-intrusive during play.

In use base station 15 operated by timekeeper 16 receives signal 17 from goal sensing system 10 when basketball 18 clears net 26. If the goal is a clock-stopping event the base station will stop the game clock. In a preferred embodiment base station 15 is communicatively coupled to scoreboard 19 that displays the game clock time. It is also preferred that the present invention be integrated with ancillary systems such as camera-based ball tracking for goal verification in games and training.

Certain structures and components are disclosed for purposes of describing an embodiment, and setting forth the best mode, but should not be construed as teaching the only possible embodiment. Rather, modifications may be made without departing from the spirit and scope of the invention as set forth in the following claims. Examples of modifications include using the goal sensing system with non-breakaway type goals, or goals not standardly equipped with cover plate pads, and modifying by attaching the sensor assembly elsewhere including the directly to the rim or the backboard, to the rim or backboard with a connector, or by adding a cover plate pad-like structure with the sensor assembly. It should be understood that all specifications, unless otherwise stated or contrary to common sense, are +/−10%, and that ranges of values set forth inherently include those values, as well as all increments between. Also, "substantially" as used herein, shall mean generally. By way of example a "substantially planar" surface includes surface imperfections but is generally planar.

What is claimed is:

1. A goal sensing system including:

a. A basketball hoop having a cover plate pad, said cover plate pad defining a depression;

b. A sensor assembly engaged with said depression wherein said sensor assembly lays substantially flush with said cover plate pad;

c. A base station communicatively coupled to said sensor assembly; and d. A game clock communicatively coupled to said base station, wherein said sensor assembly sends a signal to said base station when a goal occurs at said basketball hoop.

2. The goal sensing system of claim 1 wherein said goal may trigger said game clock to stop.

3. The goal sensing system of claim 1 wherein said sensor assembly includes plurality of infrared LEDs and a plurality of infrared sensors, each of said sensors directed towards said rim or said net.

4. The goal sensing system of claim 3 wherein each of said sensors is independently tiltable relative to other said sensors.

5. The goal sensing system of claim 3 wherein each of said sensors is associated with two infrared LEDs.

6. The goal sensing system of claim 5 having exactly three sensors oriented as a first sensor above a second and third sensor, with said second and third sensor substantially horizontally aligned.

7. A method of sensing a basketball goal including the non-sequential steps of:

a. Engaging a sensor assembly with the cover plate pad of a basketball hoop, said sensor assembly including a plurality of infrared LEDs and a plurality of infrared sensors, wherein each of said sensors is directed towards the rim or the net of said basketball hoop;

b. Communicatively coupling said sensor assembly with a base station;

c. Communicatively coupling a game clock with said base station;

d. Comparing the reflective profile of an object activating a first sensor with a pre-established first sensor basketball reflective profile;

e. Comparing the reflective profile of said object activating a second sensor with a pre-established second sensor basketball reflective profile; and f. Signaling a base station that a goal has occurred.

8. The method of sensing a basketball goal of claim 7 wherein said step of signaling said base station that a goal has occurred is performed only if said object's first and second reflective profiles match said first and second pre-established basketball profiles within prescribed tolerances.

9. The method of sensing a basketball goal of claim 8 further including the step of stopping a game clock.

* * * * *